US007319829B2

(12) United States Patent
Comstock

(10) Patent No.: US 7,319,829 B2
(45) Date of Patent: Jan. 15, 2008

(54) TRANSFER BIAS ADJUSTMENT BASED ON COMPONENT LIFE

(75) Inventor: Matthew C. Comstock, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 189 days.

(21) Appl. No.: 11/212,218

(22) Filed: Aug. 26, 2005

(65) Prior Publication Data

US 2007/0047988 A1 Mar. 1, 2007

(51) Int. Cl.
*G03G 15/16* (2006.01)
*G03G 15/00* (2006.01)

(52) U.S. Cl. ..... 399/66; 399/26

(58) Field of Classification Search ..... 399/66, 399/31, 26, 24

See application file for complete search history.

(56) References Cited

U.S. PATENT DOCUMENTS

| | | | |
|---|---|---|---|
| 4,474,455 | A | 10/1984 | Hirakura et al. |
| 4,857,959 | A | 8/1989 | Shimbo et al. |
| 4,970,557 | A | 11/1990 | Masuda et al. |
| 5,160,967 | A | 11/1992 | Tonegawa |
| 5,394,221 | A | 2/1995 | Kishimoto et al. |
| 5,697,015 | A | 12/1997 | Ream et al. |
| 5,737,663 | A * | 4/1998 | Handa et al. |
| 5,887,220 | A | 3/1999 | Nagaoka |
| 6,122,460 | A | 9/2000 | Meece et al. |
| 6,175,375 | B1 | 1/2001 | Able et al. |
| 6,337,968 | B1 | 1/2002 | Hayashida |
| 6,363,228 | B1 | 3/2002 | Ream |
| 6,381,425 | B2 | 4/2002 | Sasai |
| 6,404,999 | B1 | 6/2002 | Shoji et al. |
| 6,434,356 | B1 | 8/2002 | Ishijima et al. |
| 6,584,292 | B2 | 6/2003 | Sasai |
| 6,782,215 | B2 | 8/2004 | Komori |
| 2002/0122675 | A1 * | 9/2002 | Shoji et al. |
| 2004/0071475 | A1 * | 4/2004 | Ohori et al. |
| 2004/0141763 | A1 * | 7/2004 | Tabb et al. |
| 2006/0153578 | A1 * | 7/2006 | May |

* cited by examiner

*Primary Examiner*—Susan Lee
(74) *Attorney, Agent, or Firm*—Coats & Bennett, PLLC

(57) ABSTRACT

An electrophotographic image forming device may use a feedback loop to determine environmental conditions and accordingly set one or more operating parameters. The device may detect a resistance/capacitance characteristic of a feedback loop comprising an interface between a first component and a second component of an image forming unit. The interface may be one in which a toner image is transferred during image forming device operation. A controller may adjust the detected resistance/capacitance characteristic in response to an age of one of the first component or the second component, thereby accounting for the age or wear of the components.

19 Claims, 4 Drawing Sheets

| COMPONENT LIFE | TRANSFER FEEDBACK ADJUSTMENTS | |
|---|---|---|
| X1000 REVS | THROUGHPUT | |
| | 20 ppm | 10 ppm |
| 5 | 14 | 16 |
| 15 | 27 | 32 |
| 25 | 41 | 47 |
| 35 | 54 | 63 |
| 45 | 68 | 79 |
| 55 | 81 | 95 |
| 65 | 95 | 110 |
| 75 | 108 | 126 |
| 85 | 122 | 142 |
| 95 | 135 | 158 |
| 105 | 149 | 173 |
| 115 | 162 | 189 |
| 125 | 176 | 205 |
| 135 | 189 | 221 |
| 145 | 203 | 236 |
| 155 | 216 | 252 |
| 165 | 230 | 268 |
| 175 | 243 | 284 |
| 185 | 257 | 299 |
| 195 | 270 | 315 |
| 205 | 284 | 331 |

*FIG. 4*

TRANSFER BIAS ADJUSTMENT BASED ON COMPONENT LIFE

BACKGROUND

Certain image forming devices use an electrophotographic imaging process to develop toner images on a media sheet. The electrophotographic process uses electrostatic voltage differentials to promote the transfer of toner from component to component. For example, a voltage vector may exist between a developer roll and a latent image on a photoconductive element. This voltage vector helps promote the transfer of toner from the developer roll to the latent image in a process that is sometimes called "developing the image." A separate voltage vector may exist between the photoconductive element and a transfer member to promote the transfer of a developed image onto a substrate. In each instance, the toner transfer occurs in part because the toner itself is charged and is attracted to surfaces having an opposite charge or a lower potential.

The effective transfer of toner within an image forming device is usually dependent on many variables, including environmental conditions such as temperature and humidity. For example, in some systems there is an inverse relationship between humidity and transfer member resistance. Some image forming devices use dedicated temperature and humidity sensors to detect environmental conditions. These devices may alter operating parameters, such as the transfer bias applied to a transfer member, in response to the detected environmental conditions.

Other image forming devices measure the voltage-current characteristics of a test signal propagated through components within the device. For example, some image forming devices transmit a signal through the interface between a transfer member and a photoconductive member. The resistance and capacitance characteristics over this interface change in relation to environmental conditions. Thus, the measured resistance/capacitance characteristics may be mapped in memory to environmental values or to actual operating parameters. Accordingly, device operating parameters may be set in response to the detected resistance/capacitance values.

Unfortunately, the mapped resistance/capacitance values may not account for component deterioration that occurs with wear and use. Over time, the correlation between the mapped resistance/capacitance values and suitable operating parameters may change. For example, the photoconductive layer capacitance increases with wear, thereby reducing the effective resistance. Thus, unless age and wear are accounted for, the device operating parameters that are set in response to detected resistance/capacitance values may produce degraded images.

SUMMARY

Embodiments of the present invention are directed to devices and methods to account for device age while setting operating parameters in an image forming device in response to periodic feedback loop checks. Within an electrophotographic image forming device, an image forming unit may comprise two or more components adapted to transfer a toner image therebetween. Periodically, a sensing unit may detect a resistance/capacitance characteristic of a feedback loop comprising an interface between the components. For example, the detected resistance/capacitance characteristic of the feedback loop may represent a detected voltage produced by passing a known current through the interface between the components. Alternatively, the detected resistance/capacitance characteristic of the feedback loop may represent a detected current produced by passing a known voltage through the interface between the components. A controller may adjust the detected resistance/capacitance characteristic in response to the age of one or more of the image forming unit components. The controller may also adjust the detected resistance/capacitance characteristic in response to a device throughput.

The magnitude of the adjustment may be stored in memory as a lookup table comprising adjustment values corresponding to the age of one of the components. The magnitude of the adjustment also may be determined through linear or higher order equation calculations, with component age being an input variable. The age of a component may represent a number of revolutions experienced by a rotating member such as a photoconductive member. Also, the age of a component may represent a number of pages printed by the image forming device. Alternatively, the age of a component may represent an elapsed time. Once the adjusted value for the resistance/capacitance characteristic is determined, operating parameters, such as a bias voltage applied to a transfer or fuser component may be set.

BRIEF DESCRIPTION OF THE DRAWINGS

FIG. 4 is a representative lookup table showing transfer feedback adjustment values for various component ages and for various device throughputs according to one embodiment of the present invention.

DETAILED DESCRIPTION

Figure 1:
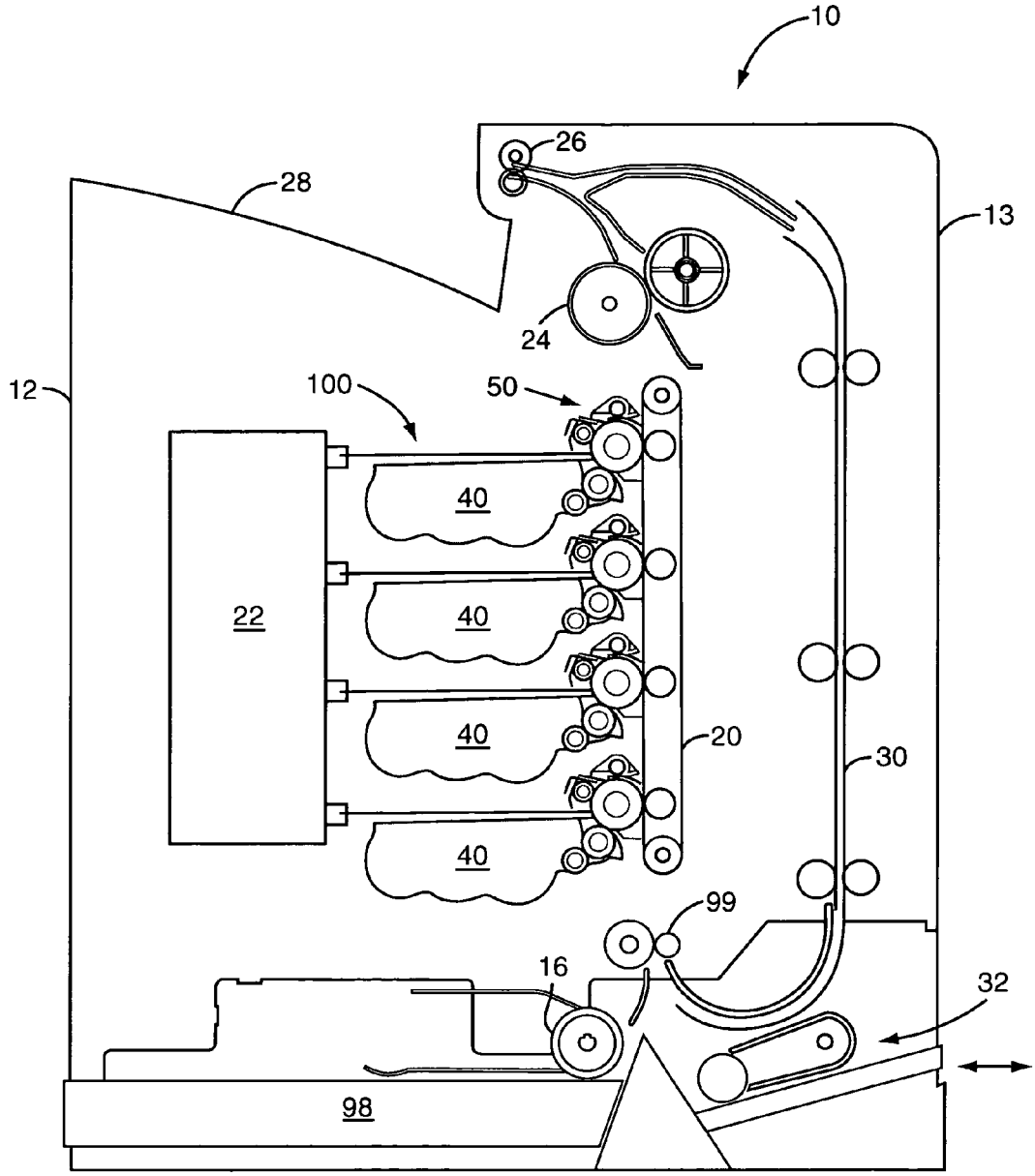
FIG. 1 is a schematic view of an image forming device according to one embodiment of the present invention.

Embodiments disclosed herein are directed to devices and related methods to adjust component bias levels in an image forming device to compensate for component age and wear. These embodiments may be applicable in a device that uses an electrophotographic imaging process such as the representative image forming device 10 shown in FIG. 1. The exemplary image forming device 10 comprises a main body 12 and a door assembly 13. A media tray 98 with a pick mechanism 16, and a multi-purpose feeder 32, are conduits for introducing media sheets into the device 10. The media tray 98 is preferably removable for refilling, and located on a lower section of the device 10.

Media sheets are moved from the input and fed into a primary media path. One or more registration rollers 99 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An optical scanning device 22 forms a latent image on a photoconductive member 51 (not explicitly referenced in FIG. 1, but see FIG. 2) within the image forming units 100. The media sheet with loose toner is then moved through a fuser 24 to fix the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

Figure 2:
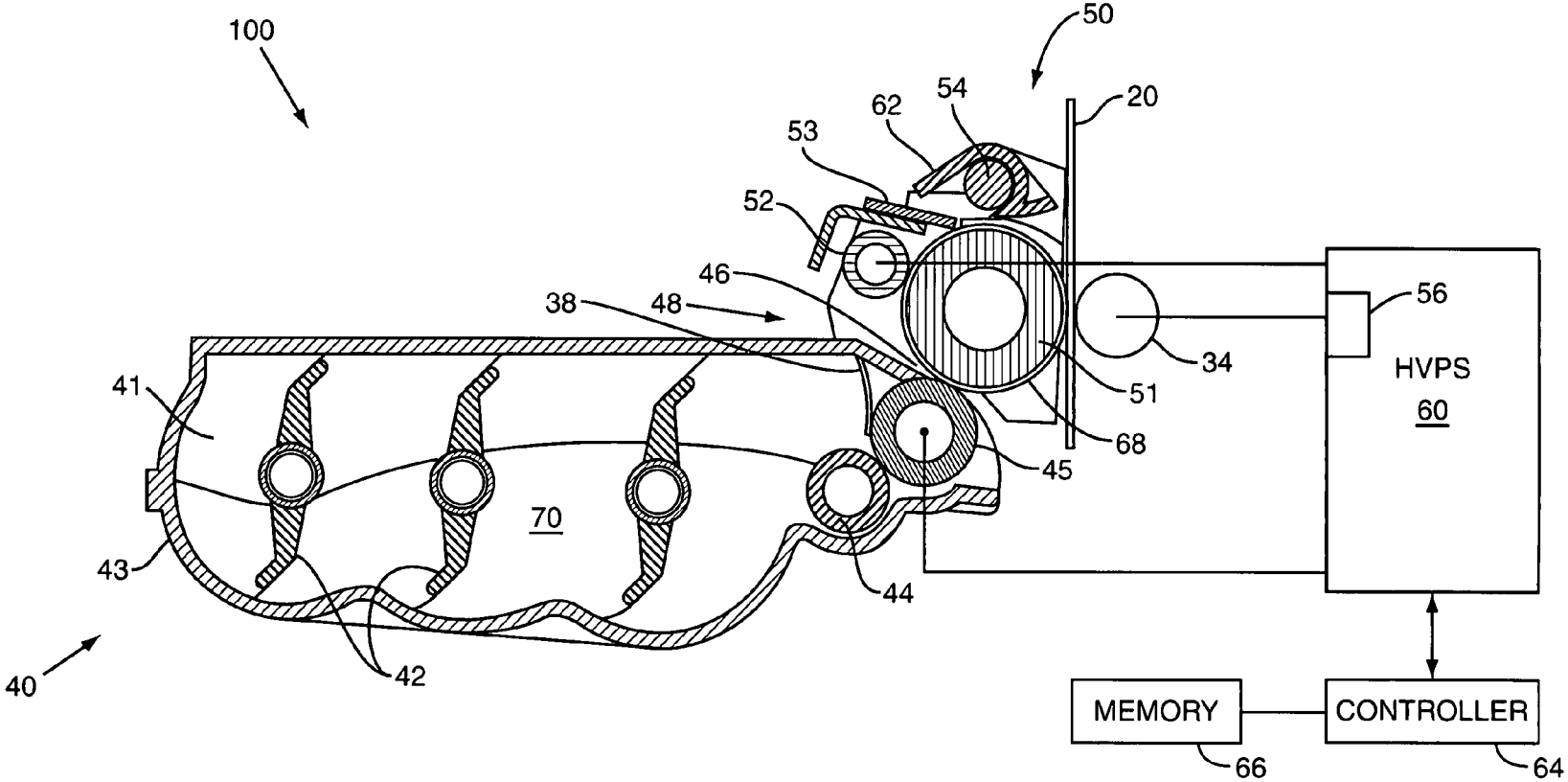
FIG. 2 is a cross-sectional view of an image forming unit and associated power supply and transfer feedback circuit according to one embodiment of the present invention.

As illustrated in FIGS. 1 and 2, the image forming units 100 are comprised of a developer unit 40 and a photoconductor (PC) unit 50. The developer unit 40 comprises an exterior housing 43 that forms a reservoir 41 for holding a supply of toner 70. One or more agitating members 42 are positioned within the reservoir 41 for agitating and moving the toner 70 towards a toner adding roll 44 and the developer member 45. The developer unit 40 further comprises a doctor element 38 that controls the toner 70 layer formed on the developer member 45. In one embodiment, a cantilevered, flexible doctor blade as shown in FIG. 2 may be used. Other types of doctor elements 38, such as spring-loaded, ingot style doctor elements may be used. The developer unit 40 and PC unit 50 are structured so the developer member 45 is accessible for contact with the photoconductive member 51 at a nip 46. Consequently, the developer member 45 is positioned to develop latent images formed on the photoconductive member 51.

The exemplary PC unit 50 comprises the photoconductive member 51, a charge roller 52, a cleaner blade 53, and a waste toner auger 54 all disposed within a housing 62 that is separate from the developer unit housing 43. In one embodiment, the photoconductive member 51 is an aluminum hollow-core drum with a photoconductive coating 68 comprising one or more layers of light-sensitive organic photoconductive materials. The photoconductive member 51 is mounted protruding from the PC unit 50 to contact the developer member 45 at nip 46. Charge roller 52 is electrified to a predetermined bias by a high voltage power supply (HVPS) 60 that is adjusted or turned on and off by a controller 64. The charge roller 52 applies an electrical charge to the photoconductive coating 68. During image creation, selected portions of the photoconductive coating 68 are exposed to optical energy, such as laser light, through aperture 48. Exposing areas of the photoconductive coating 68 in this manner creates a discharged latent image on the photoconductive member 51. That is, the latent image is discharged to a lower charge level than areas of the photoconductive coating 68 that are not illuminated.

The developer member 45 (and hence, the toner 70 thereon) is charged to a bias level by the HVPS 60 that is advantageously set between the bias level of charge roller 52 and the discharged latent image. In one embodiment, the developer member 45 is comprised of a resilient (e.g., foam or rubber) roller disposed around a conductive axial shaft. Other compliant and rigid roller-type developer members 45 as are known in the art may be used. Charged toner 70 is carried by the developer member 45 to the latent image formed on the photoconductive coating 68. As a result of the imposed bias differences, the toner 70 is attracted to the latent image and repelled from the remaining, higher charged portions of the photoconductive coating 68. At this point in the image creation process, the latent image is said to be developed.

The developed image is subsequently transferred to a media sheet being carried past the photoconductive member 51 by media transport belt 20. In the exemplary embodiment, a transfer roller 34 is disposed behind the transport belt 20 in a position to impart a contact pressure at the transfer nip. In addition, the transfer roller 34 is advantageously charged, typically to a polarity that is opposite the charged toner 70 and charged photoconductive member 51 to promote the transfer of the developed image to the media sheet.

The cleaner blade 53 contacts the outer surface of the photoconductive coating 68 to remove toner 70 that remains on the photoconductive member 51 following transfer of the developed image to a media sheet. The residual toner 70 is moved to a waste toner auger 54. The auger 54 moves the waste toner 70 out of the photoconductor unit 50 and towards a waste toner container (not shown), which may be disposed of once full.

In one embodiment, the charge roller 52, the photoconductive member 51, the developer member 45, the doctor element 38 and the toner adding roll 44 are all negatively biased. The transfer roller 34 may be positively biased to promote transfer of negatively charged toner 70 particles to a media sheet. Those skilled in the art will comprehend that an image forming unit 100 may implement polarities opposite from these.

Periodically, such as between print jobs or at the start of a print job, the HVPS 60, under the control of controller 64, implements a transfer servo routine to determine a transfer feedback voltage that varies in relation to changing operating conditions. The printer controller 64 may adjust operating parameters (e.g., bias voltage applied to the transfer roller 34 or the fuser 24 shown in FIG. 1) based on the determined transfer feedback voltage to compensate for changes in operating conditions, including temperature and humidity.

In one embodiment, the transfer feedback voltage that produces a predetermined current through the transfer roller 34 is determined. More specifically, the HVPS 60 includes a sensing circuit 56 adapted to sense the voltage transmitted to the transfer roller 34 that produces a target current of 8 μA. This threshold circuit 56 produces a state change (i.e., low to high transition, otherwise referred to as a positive feedback) in a binary output signal that is sensed by the controller 64 when the transfer current equals or exceeds the target current of 8 μA. If the transfer current remains below the target current, the output of the sensing circuit 56 remains low.

In the exemplary configuration shown and described, the applied current travels through various components, including the transfer roller 34, the media transport belt 20, the photoconductive member 51 and ultimately to ground. Some of the applied current may also travel to ground via the cleaner blade 53, charge roller 52, and/or developer member 45. The voltage that produces the target current is referred to as the "transfer feedback voltage." The value of the transfer feedback voltage is transmitted to or otherwise determined by the controller 64. In one embodiment, operating parameters are mapped in memory 66 to different values of the transfer feedback voltage. The controller 64 reads the operating parameter for a measured transfer feedback voltage and, in turn, sets appropriate operating parameters for subsequent printing. FIG. 1 shows that there are four image forming units 100 in the representative image forming device. Accordingly, the process of determining the transfer feedback voltage may be performed for each transfer location in the image forming device 10. In one embodiment, the process is performed simultaneously at each image forming unit 100. Alternatively, the process may be performed sequentially at each image forming unit 100.

In addition to environmental influences, component age and usage may also affect the transfer feedback voltage used to set the instantaneous operating parameters. For example, the capacitance of the photoconductive coating 68 on the photoconductive member 51 is related to its thickness. A new photoconductive member 51 is coated to a specified thickness. However, during printing, the photoconductive coating 68 is worn by contact with other components, such as a cleaner blade 53. As the photoconductive coating 68 thins due to wear, the capacitance of the junction between the photoconductive member 51 and other components in contact with the photoconductive coating 68 increases. For instance, the capacitance of the junction between the transfer roller 34 and the photoconductive member 51 increases as the photoconductive coating 68 thins. This increased capacitance causes the transfer feedback voltage to drop as the effective resistance of the feedback loop is reduced. This drop in resistance and transfer feedback voltage may be interpreted incorrectly by controller 64 as an increase in humidity. In turn, the printer controller 64 may tend to overcompensate for the erroneously low transfer feedback voltage. Ultimately, the change in capacitance of the photoconductive coating 68 on the photoconductive member 51 may become so great that the selected operating parameter falls outside a desired operating window. As a result, print quality likely degrades.

Accordingly, an adjustment may be implemented based on knowledge that the rate of wear of the photoconductive coating 68 on the photoconductive member 51 is consistent and repeatable. Different approaches may be used to compensate for the changed capacitance of the photoconductive coating 68. In one embodiment, the capacitance of photoconductive coating 68 may correlate with a number of photoconductive member 51 revolutions. This age-dependent deviation may be represented by a function (linear or higher order) or a look up table. Then, during the transfer feedback process, the measured voltage may be adjusted based on the age of the photoconductive member 51.

Figure 3:
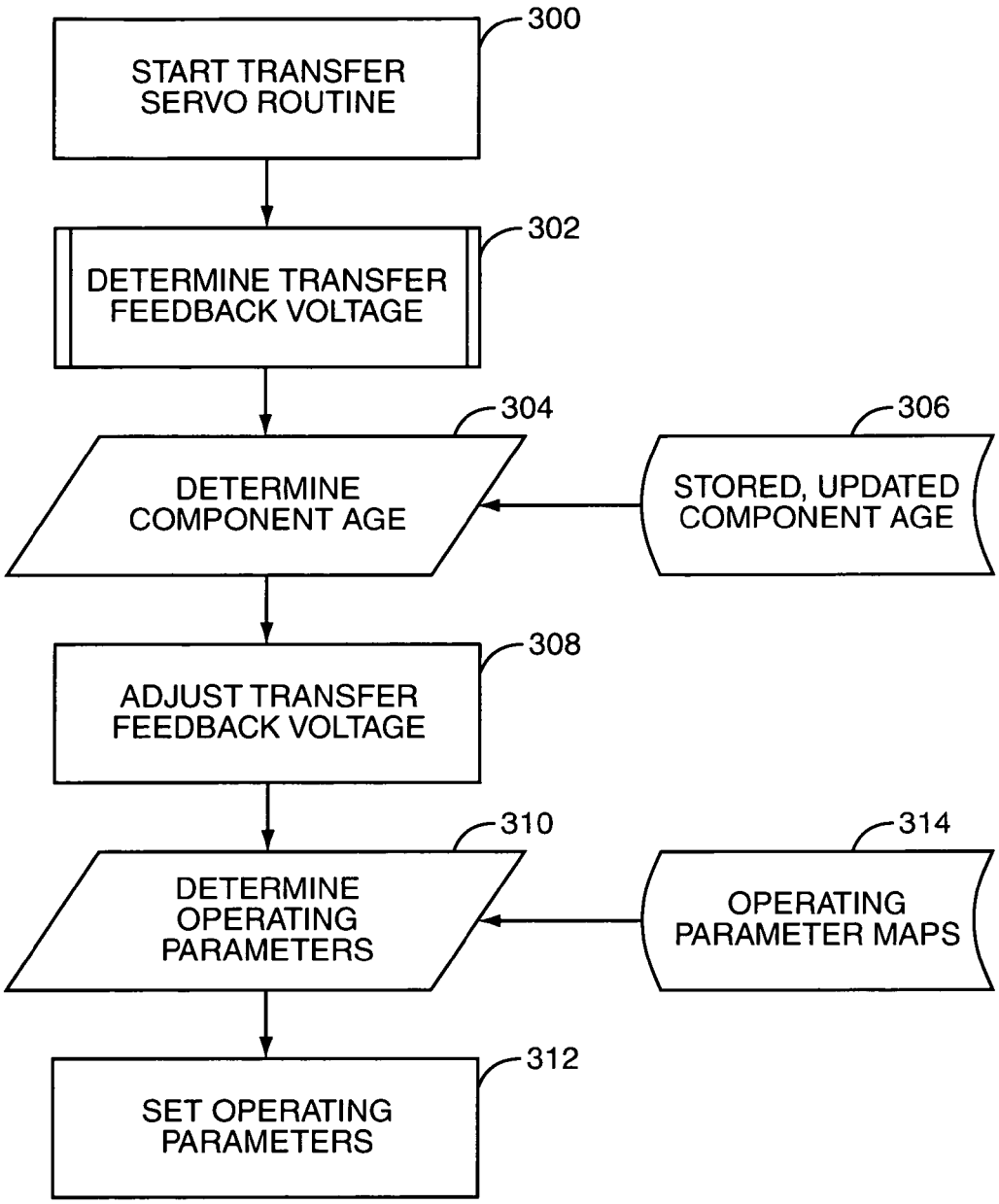
FIG. 3 is a flow diagram illustrating a process by which operating parameters may be adjusted in response to a detected device age according to one embodiment of the present invention.

The flow diagram illustrated in FIG. 3 shows one embodiment of a process by which this transfer feedback voltage adjustment may be implemented. In step 300, the transfer servo routine begins. Next, the process by which the transfer feedback voltage is determined as described above is executed. In one embodiment, a sensing circuit 56 (see FIG. 2) is adapted to sense the voltage transmitted to the transfer roller 34 that produces a predetermined current. This transfer feedback voltage is determined in step 302. Then, the relevant component age is determined in step 304. In one embodiment, the age of a photoconductive member 51 is determined as an indication of the change in the photoconductive coating 68 on the photoconductive member 51. In one embodiment, the age of the photoconductive member 51 is maintained as a running, updated count representing the number of revolutions encountered by photoconductive member 51 since a new photoconductive member 51 was installed. Other age indicators may be used. In one embodiment, the age of the photoconductive member 51 may be represented as a running clock measuring run time since a new photoconductor member 51 was installed. In another embodiment, the age of the photoconductive member 51 is maintained as a running count representing the number of pages produced since a new photoconductor member 51 was installed. For either of these examples, the controller 64 (shown in FIG. 2) may store this running count in memory 66 during normal image forming device operations (step 306). The controller 64 may read this value from memory 66 as necessary to perform the steps outlined in FIG. 3.

Subsequently, the relevant component age may be used in step 308 to adjust the measured transfer feedback voltage. Different approaches may be used to adjust the measured transfer feedback voltage. As indicated above, a suitable adjustment may be executed as a mathematical calculation. In one embodiment, the measured transfer feedback voltage may be adjusted using the following equation:

$$V_{adjusted}=V_{initial}+K1\times\text{Age} \tag{1}$$

where $V_{initial}$ is an initial feedback voltage, $V_{adjusted}$ is an updated feedback voltage, Age is the component age, and K1 represents a conversion term that relates component age to voltage shift. In the present embodiment, $V_{initial}$ is the transfer feedback voltage measured in step 302, $V_{adjusted}$ is the adjusted transfer feedback voltage determined in step 308, and the Age term is the component age read in step 304 and represents the age of the photoconductive member 51 in terms of the number of revolutions turned by the photoconductive member 51 since installation. With the transfer feedback voltage adjusted using Equation (1), the appropriate operating parameters for image forming device 10 may be determined (step 310) from stored data maps. These data maps may be predetermined and stored in memory 66. For example, the operating parameter maps may be factory-set and stored during manufacturing. Alternatively, these operating parameter maps may be dependent upon periodic configuration routines that may include patch sensing or user-initiated print quality routines. In either case, the appropriate operating parameter maps are stored (step 314) for later access by controller 64. The controller 64 may then set (step 312) these operating parameters accordingly. In one embodiment, the controller may set the operating bias voltage for the transfer roller 34. In one embodiment, the controller 64 may set the operating bias voltage for the fuser 24. In other embodiments, the controller 64 may set the operating bias voltage for other image forming components shown in FIG. 2, such as the charge roller 52 or developer member 45.

The transfer feedback voltage adjustment that is implemented using Equation (1) may be applicable for a certain print speed. For example, where the representative image forming device 10 is capable of producing images of varying quality, the device throughput in pages per minute (PPM) may vary as well. In one embodiment, Equation (1) may be applicable for a device throughput of about 20 PPM. A lower device throughput may correspond to a higher level of detail or a larger dots per inch (DPI) setting for the output images. Accordingly, a different transfer voltage adjustment may be necessary. For example, Equation (2) below may be applicable with a device throughput of 10 PPM or 6 PPM.

$$V_{adjusted}=V_{initial}+K2\times\text{Age} \tag{2}$$

In one embodiment, the constant K2 associated with a lower device throughput may be larger than the constant K1. In one embodiment, the value for the constant K1 associated with a device throughput of 20 PPM is between about 1.3-1.4 volts per 1000 revolutions. A corresponding value for the constant K2 associated with a device throughput of 10 PPM is between about 1.5-1.6 volts per 1000 revolutions. Different values for constants K1 and K2 may be appropriate depending on the component considered or other device applications. In embodiments where the adjustment compensates for the wear of a photoconductive coating 68, the wear rate may be dependent on the photoconductive material. It may also depend on the design and material used for the cleaning blade 53. A stiffer cleaning blade 53 generally results in a faster wear rate. Also, the amount of interference between the cleaning blade 53 and the photoconductive member 51 affects the wear rate—the greater the interference, the higher the wear rate. The wear rate may also be influenced by environment. These considerations may be relevant to the values used for constants K1 and K2.

The amount by which the transfer feedback voltage is adjusted may be stored as a lookup table instead of equations, as presented above. An exemplary lookup table for the measured transfer feedback voltage is shown in FIG. 4, which represents a table of adjustments that may be stored in memory 66 and accessed in step 308 to determine the relevant adjustment. The tabulated values shown in FIG. 4 may represent an adjustment to the transfer feedback voltage that is measured in step 302 of FIG. 3. The values shown in FIG. 4 reflect a general increase in the amount of transfer feedback adjustment that is applied as component life increases. This increase may be applied to offset the expected change in capacitance of the photoconductive coating 68 on the photosensitive member 51 that comes with component age. Furthermore, different sets of adjustment values may be used for different device throughput speeds. Accordingly, the representative lookup table shown in FIG. 4 includes device age on one axis and device throughput speed on the other axis. In the present embodiment, the amount of transfer feedback voltage adjustment is determined by accessing the appropriate address for a given component age and throughput speed.

The present invention may be carried out in other specific ways than those herein set forth without departing from the scope and essential characteristics of the invention. For example, embodiments described above have contemplated transmitting a test pulse through a transfer roller 34 to determine the resistance/capacitance characteristics of image forming components that are involved in the transfer of toner. However, it is also possible to transmit this type of test pulse through charge roller 52 or developer member 45 as shown in FIG. 2.

Furthermore, the embodiments described above have contemplated a voltage adjustment to a transfer feedback voltage. Different image forming devices 10 may also transmit a test pulse of a known voltage through the image forming units and determine the current produced by such a pulse. In this scenario, the resulting current may tend to increase with component wear. As a photoconductive coating 68 on a photoconductive member 51 thins with age, the capacitance increases and the effective resistance decreases, which results in larger current flow for a given voltage. Accordingly, the appropriate transfer bias adjustment may require a decrease in the measured current to account for age and wear.

Further, certain embodiments described above have described a technique to account for a change in the resistance/capacitance characteristics of a photoconductive coating 68 with age and wear. Other similar approaches may be used to account for age and wear of different components. For example, the representative image forming unit 100 shown in FIG. 2 includes a transport belt 20 that is disposed between a transfer roller 34 and a photoconductive member. The resistance/capacitance characteristics of this exemplary belt 20 may also change with age and wear. In one embodiment, the resistance or capacitance of the belt 20 may increase with age. Thus, the measured transfer feedback voltage may require downward adjustment. Where current is measured in this scenario, the change in resistance or capacitance of the belt 20 with age and wear may require an increase in the measured current. These modifications may be equally applicable to a transfer member 45 whose electrical characteristics change with age and use.

Additionally, the transfer feedback voltage routines described above have contemplated determining a voltage that results from transmitting a known current through the transfer roller 34. In other embodiments, similar results may be obtained by using a constant current power supply and using a voltmeter to measure the resulting voltage produced when a known current is passed through the image forming unit 100. Similarly, other systems may implement a constant voltage power supply and an ammeter to measure the resulting current produced when a known voltage is transmitted through the image forming unit 100. These alternatives provide different approaches to determining the resistance/capacitance characteristics of the components within the image forming unit 100 that are involved in the transfer of toner particles.

Lastly, the embodiments described above have contemplated an adjustment to the voltage or current that is measured in response to passing a known test signal through the image forming unit 100. In other embodiments, the operating parameter maps stored in memory 66 may include additional entries reflecting component age. Referring to FIG. 3, one embodiment may eliminate step 308 in favor of storing additional maps in step 314 to account for component age and wear.

Those skilled in the art should also appreciate that the control circuitry associated with controller 64 shown in FIG. 2 for implementing the present invention may comprise hardware, software, or any combination thereof. For example, circuitry for initiating, performing, and adjusting the transfer feedback voltage may be a separate hardware circuit, or may be included as part of other processing hardware. More advantageously, however, the processing circuitry in these devices is at least partially implemented via stored computer program instructions for execution by one or more computer devices, such as microprocessors, Digital Signal Processors (DSPs), ASICs or other digital processing circuits included in the controller 64. The stored program instructions may be stored in electrical, magnetic, or optical memory devices, such ROM and RAM modules, flash memory, hard disk drives, magnetic disc drives, optical disc drives and other storage media known in the art.

Furthermore, the exemplary image forming device 10 described herein uses contact-development technology—a scheme that implements a physical contact between components to promote the transfer of toner. The transfer bias adjustment may also be incorporated in image forming devices that use a jump-gap-development technology—a scheme that implements a space between components that are involved in toner development of latent images on the photoconductor. The transfer bias adjustment may be incorporated in a variety of image forming devices including, for example, printers, fax machines, copiers, and multi-functional machines including vertical and horizontal architectures as are known in the art of electrophotographic reproduction. The present embodiments are, therefore, to be considered in all respects as illustrative and not restrictive, and all changes coming within the meaning and equivalency range of the appended claims are intended to be embraced therein.

What is claimed is:

1. An electrophotographic image forming device comprising:

an image forming unit comprising a first component and a second component disposed to transfer a toner image therebetween;

a sensing unit operative to detect a resistance/capacitance characteristic of a feedback loop comprising an interface between the first component and the second component; and a controller operative to selectively adjust the detected resistance/capacitance characteristic in response to an age of one of the first component or the second component.

2. The device of claim 1 wherein the detected resistance/capacitance characteristic of the feedback loop comprises a detected voltage produced by passing a known current through one of the first component or the second component.

3. The device of claim 1 wherein the detected resistance/capacitance characteristic of the feedback loop comprises a detected current produced by passing a known voltage through one of the first component or the second component.

4. The device of claim 1 wherein the controller is further operative to selectively adjust the detected resistance/capacitance characteristic in response to a device throughput.

5. The device of claim 1 further comprising a memory device adapted to store a lookup table comprising adjustment values corresponding to the age of one of the first component or the second component.

6. The device of claim 1 wherein the age of one of the first component or the second component represents a number of revolutions experienced by a photoconductive member.

7. The device of claim 1 wherein the age of one of the first component or the second component represents a number of pages printed by the image forming device.

8. The device of claim 1 wherein the age of one of the first component or the second component represents an elapsed time.

9. A method of adjusting an operating parameter in an image forming device, the method comprising:

periodically determining a resistance/capacitance characteristic of a feedback loop comprising an interface between a first component and a second component of image forming unit, the resistance/capacitance characteristic of the feedback loop used in setting an operating parameter for the image forming unit;

determining the age of the first component;

determining an adjusted resistance/capacitance characteristic of the feedback loop in accordance with the age of the first component;

setting an operating parameter for the image forming unit using the adjusted resistance/capacitance characteristic of the feedback loop;

wherein determining the resistance/capacitance characteristic of the feedback loop comprises determining a voltage required to pass a known current through one of the first or the second component.

10. The method of claim 9 wherein determining an adjusted resistance/capacitance characteristic of the feedback loop comprises adjusting the voltage upward in proportion to the age of the first component.

11. The method of claim 9 wherein the second component is a transfer member.

12. The method of claim 9 wherein the first component is a photoconductive member.

13. The method of claim 9 wherein determining the age of the first component comprises counting the number of revolutions experienced by a rotating first component.

14. The method of claim 9 wherein determining an adjusted resistance/capacitance characteristic of the feedback loop comprises adjusting the resistance/capacitance characteristic in proportion to the age of the first component to account for a decreasing thickness of a coating disposed on the first component.

15. A method of adjusting a transfer bias in an image forming device, the method comprising:

periodically measuring a transfer feedback voltage for a feedback loop comprising an interface between a transfer member and a photoconductive member, the transfer feedback voltage determined by passing a known current through the interface between a transfer member and a photoconductive member;

storing a set of transfer bias values, each corresponding to different ranges of transfer feedback voltages;

determining the age of the photoconductive member;

determining an adjusted transfer feedback voltage by increasing the transfer feedback voltage in proportion to the age of the photoconductive member;

setting the transfer bias applied to the transfer member during subsequent print jobs using the adjusted transfer feedback voltage.

16. The method of claim 15 wherein increasing the transfer feedback voltage in proportion to the age of the photoconductive member further comprises increasing the transfer feedback voltage for a given photoconductive member age by a larger amount for smaller image forming device throughputs.

17. The method of claim 15 wherein determining the age of the photoconductive member comprises counting the number of revolutions experienced by the photoconductive member since the photoconductive member was installed in the image forming device.

18. The method of claim 15 wherein determining an adjusted transfer feedback voltage comprises calculating the adjusted transfer feedback voltage using an equation with the measured transfer feedback voltage and the age of the photoconductive member being independent variables.

19. The method of claim 15 wherein determining an adjusted transfer feedback voltage comprises reading the magnitude of transfer feedback voltage adjustment from a lookup table.

* * * * *